US009506195B2

(12) United States Patent
Chen et al.

(10) Patent No.: US 9,506,195 B2
(45) Date of Patent: Nov. 29, 2016

(54) COMPOSITIONS AND METHODS OF MAKING PAPER PRODUCTS

(71) Applicant: KEMIRA OYJ, Helsinki (FI)

(72) Inventors: Junhua Chen, Mableton, GA (US); Chen Lu, Marietta, GA (US); Scott Rosencrance, Douglasville, GA (US); Frank Zimmermann, Cumming, GA (US)

(73) Assignee: KEMIRA OYJ, Helsinki (FI)

( * ) Notice: Subject to any disclaimer, the term of this patent is extended or adjusted under 35 U.S.C. 154(b) by 0 days.

(21) Appl. No.: 15/046,741

(22) Filed: Feb. 18, 2016

(65) Prior Publication Data

US 2016/0201267 A1 Jul. 14, 2016

Related U.S. Application Data

(62) Division of application No. 14/408,404, filed as application No. PCT/US2013/046102 on Jun. 17, 2013, now Pat. No. 9,328,462.

(60) Provisional application No. 61/663,317, filed on Jun. 22, 2012.

(51) Int. Cl.

| | |
|---|---|
| ***D21H 17/55*** | (2006.01) |
| ***D21H 21/18*** | (2006.01) |
| ***D21H 21/20*** | (2006.01) |
| ***D21H 27/00*** | (2006.01) |
| ***D21H 17/37*** | (2006.01) |
| ***D21H 17/25*** | (2006.01) |
| ***D21H 17/47*** | (2006.01) |
| ***D21H 21/10*** | (2006.01) |

(52) U.S. Cl.

CPC ..... *D21H 17/55* (2013.01); *D21H 17/25* (2013.01); *D21H 17/37* (2013.01); *D21H 17/375* (2013.01); *D21H 17/47* (2013.01); *D21H 21/10* (2013.01); *D21H 21/18* (2013.01); *D21H 21/20* (2013.01); *D21H 27/002* (2013.01)

(58) Field of Classification Search

CPC ..... D21H 17/55; D21H 17/25; D21H 17/01; D21H 17/375

USPC ..... 162/168.3

See application file for complete search history.

(56) References Cited

U.S. PATENT DOCUMENTS

| | | | |
|---|---|---|---|
| 6,294,645 | B1 | 9/2001 | Allen et al. |
| 7,897,013 | B2 | 3/2011 | Hagipol et al. |
| 2003/0131962 | A1 | 7/2003 | Lindsay et al. |
| 2011/0247775 | A1 | 10/2011 | Sutman et al. |

FOREIGN PATENT DOCUMENTS

| | | | |
|---|---|---|---|
| WO | 99-05361 | A1 | 2/1999 |

*Primary Examiner* — Mark Halpern

(74) *Attorney, Agent, or Firm* — Robert P. Michael, Esq.; Carter, DeLuca, Farrell & Schmidt, LLP

(57) ABSTRACT

One or more embodiments include paper, methods of making paper, compositions, and the like, are provided. In various exemplary embodiments described herein, a paper material may be formed by treating a cellulosic fiber or an aqueous pulp slurry with a treatment composition comprising an anionic polyacrylamide resin and an aldehyde-functionalized polymer resin.

14 Claims, No Drawings

COMPOSITIONS AND METHODS OF MAKING PAPER PRODUCTS

CROSS-REFERENCE TO RELATED APPLICATION

This application is a divisional patent application which claims priority to U.S. Non-Provisional Patent application entitled "COMPOSITIONS AND METHODS OF MAKING PAPER PRODUCTS" having Ser. No. 14/408,404, filed on Dec. 16, 2014, which is a 371 national phase application of PCT application serial number PCT/US2013/46102, filed on Dec. 27, 2013, which claims priority to U.S. provisional application entitled "COMPOSITIONS AND METHODS OF MAKING PAPER PRODUCTS," having Ser. No. 61/663,317, filed on Jun. 22, 2012, each of which is entirely incorporated herein by reference.

BACKGROUND

1. Field of the Art

The present embodiments relate to paper and paper making.

2. Background

Paper sheets are made by dewatering a pulp suspension, forming a uniform web, and drying the web. Pulp suspensions often contain large amounts of anionic substances including small fiber fines, inorganic fillers, hydrophobic pitch particles, and contaminants from waste paper recycling. Therefore, retention chemicals are commonly added to the pulp suspension to fix the anionic substances to the final paper sheet. In addition, retention chemicals accelerate the pulp dewatering process, resulting in a higher paper production rate.

One of the widely applied retention programs employs a combination of a high molecular weight anionic flocculant and a low molecular weight cationic coagulant. Typical commercial anionic flocculants are copolymers of acrylic acid and acrylamide prepared either by inverse emulsion polymerization or by solution polymerization. Common commercial coagulants are poly(diallyldimethylammonium chloride), polyamines prepared from dimethylamine, ethylene diamine, and epichlorohydrin, alum, polyaluminum chloride (PAC), cationic starch, vinylamine-containing copolymers, and polyethylenimine (PEI). It is generally accepted that coagulants can deposit on the anionic surfaces of various substances and generate cationic patches. Afterwards, the high molecular weight anionic flocculants can bridge cationic patches, increasing the fixation of fines and fillers.

Recently, the water systems in papermaking mills have become ever more closed. This trend leads to an increase of dissolved and suspended solids, such as salt and anionic substances. Water chemistry plays a major role in the effectiveness of a retention program. Salt and anionic substances often interfere with the interactions between retention chemicals and various substances in the pulp suspension, reducing the effectiveness of the retention program. In addition, a reduction in retention efficiency leads to a further increase of dissolved and suspended solids. Consequently, there is an increasing demand for a more effective retention program.

Glyoxalated polyacrylamide (GPAM) is a common temporary wet strength resin. GPAM is typically prepared by reacting glyoxal and a cationic polyacrylamide base polymer (for example, as discussed in U.S. Pat. Nos. 3,556,932, 4,605,702, and 7,828,934, each of which is incorporated herein by reference). GPAM is typically added in the pulp suspension before paper sheet formation. Upon drying of the treated paper sheet, GPAM is believed to form covalent bonds with paper cellulose to increase paper dry strength. Since the covalent bond between GPAM and cellulose is reversible in water, this wet strength may decrease over time. GPAM strength performance also can be adversely affected by relatively high pH and high levels of alkalinity when present as bicarbonate ions.

The description herein of certain advantages and disadvantages of known methods and compositions is not intended to limit the scope of the present disclosure. Indeed the present embodiments may include some or all of the features described above without suffering from the same disadvantages.

SUMMARY

In view of the foregoing, one or more embodiments include paper, methods of making paper, compositions, and the like, are provided.

At least one embodiment provides paper formed by a method that includes: treating a cellulosic fiber or an aqueous pulp slurry with a treatment composition comprising: an anionic polyacrylamide resin and an aldehyde-functionalized polymer resin, where the complex of the anionic polyacrylamide resin and the aldehyde-functionalized polymer resin possesses a net cationic charge.

At least one embodiment provides a method of making a paper that includes: introducing to a cellulosic fiber or an aqueous pulp slurry, a treatment composition comprising an anionic polyacrylamide resin and an aldehyde-functionalized polymer resin, where the complex of the anionic polyacrylamide resin and the aldehyde-functionalized polymer resin possesses a net cationic charge.

At least one embodiment provides a treatment composition that includes: treatment composition comprising an anionic polyacrylamide resin and an aldehyde-functionalized polymer resin, where the complex of the anionic polyacrylamide resin and the aldehyde-functionalized polymer resin possesses a net cationic charge.

DETAILED DESCRIPTION OF THE EMBODIMENTS

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

Where a range of values is provided, it is understood that each intervening value, to the tenth of the unit of the lower limit (unless the context clearly dictates otherwise), between the upper and lower limit of that range, and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure can employ, unless otherwise indicated, techniques of chemistry, synthetic organic chemistry, paper chemistry, and the like, which are within the skill of the art. Such techniques are explained fully in the literature.

The examples are put forth so as to provide those of ordinary skill in the art with a complete disclosure and description of how to perform the methods and use the compositions and compounds disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is at or near atmospheric. Standard temperature and pressure are defined as 20° C. and 1 atmosphere.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference can be made to a number of terms and phrases that shall be defined to have the following meanings unless a contrary intention is apparent.

DEFINITIONS

The term "substituted" refers to any one or more hydrogens on the designated atom or in a compound that can be replaced with a selection from the indicated group, provided that the designated atom's normal valence is not exceeded, and that the substitution results in a stable compound.

"Acrylamide monomer" refers to a monomer of formula: $H_2C{=}C(R_1)C(O)NR_2R_3$, where $R_1$ can be H or $C_1$-$C_4$ alkyl, $R_2$ and $R_3$ can independently be H, $C_1$-$C_4$ alkyl, aryl or arylalkyl. Exemplary acrylamide monomers include acrylamide and methacrylamide.

"Anionic monomer" refers to a monomer of formula: $HOC(O)C(R_a){=}CH_2$, wherein $R_a$ can be H, $C_1$-$C_4$ alkyl, aryl or arylalkyl.

"Aldehyde" refers to a compound containing one or more aldehyde (—CHO) groups, where the aldehyde groups are capable of reacting with the amino or amido groups of a polymer comprising amino or amido groups as described herein. Exemplary aldehydes can include formaldehyde, paraformaldehyde, glutaraldehyde, glyoxal, and the like.

"Aliphatic group" refers to a saturated or unsaturated, linear or branched hydrocarbon group and encompasses alkyl, alkenyl, and alkynyl groups, for example.

"Alkyl" refers to a monovalent group derived from a straight or branched chain saturated hydrocarbon by the removal of a single hydrogen atom. Exemplary alkyl groups include methyl, ethyl, n- and iso-propyl, cetyl, and the like.

"Alkylene" refers to a divalent group derived from a straight or branched chain saturated hydrocarbon by the removal of two hydrogen atoms. Exemplary alkylene groups include methylene, ethylene, propylene, and the like.

"Amido group" and "amide" refer to a group of formula —$C(O)NY_1Y_2$, where $Y_1$ and $Y_2$ are independently selected from H, alkyl, alkylene, aryl and arylalkyl.

"Amino group" and "amine" refer to a group of formula —$NY_3Y_4$, where $Y_3$ and $Y_4$ are independently selected from H, alkyl, alkylene, aryl, and arylalkyl.

"Aryl" refers to an aromatic monocyclic or multicyclic ring system of about 6 to about 10 carbon atoms. The aryl is optionally substituted with one or more $C_1$-$C_{20}$ alkyl, alkylene, alkoxy, or haloalkyl groups. Exemplary aryl groups include phenyl or naphthyl, or substituted phenyl or substituted naphthyl.

"Arylalkyl" refers to an aryl-alkylene-group, where aryl and alkylene are defined herein. Exemplary arylalkyl groups include benzyl, phenylethyl, phenylpropyl, 1-naphthylmethyl, and the like.

"Alkoxy" refers to an alkyl group as defined above with the indicated number of carbon atoms attached through an oxygen bridge. Exemplary alkoxy groups include methoxy, ethoxy, n-propoxy, i-propoxy, n-butoxy, s-butoxy, t-butoxy, n-pentoxy, and s-pentoxy.

"Halogen" refers to fluorine, chlorine, bromine, or iodine.

"Paper strength" means a property of a paper material, and can be expressed, inter alia, in terms of dry strength and/or wet strength. Dry strength is the tensile strength exhibited by the dry paper sheet, typically conditioned under uniform humidity and room temperature conditions prior to testing. Wet strength is the tensile strength exhibited by a paper sheet that has been wetted with water prior to testing.

As used herein, the terms "paper" or "paper product" (these two terms are used interchangeably) is understood to include a sheet material that contains paper fibers, and may also contain other materials. Suitable paper fibers include natural and synthetic fibers, for example, cellulosic fibers, wood fibers of all varieties used in papermaking, other plant fibers, such as cotton fibers, fibers derived from recycled paper; and the synthetic fibers, such as rayon, nylon, fiberglass, or polyolefin fibers. The paper product may be composed only of natural fibers, only of synthetic fibers, or a mixture of natural fibers and synthetic fibers. For instance, in the preparation of a paper product a paper web or paper material may be reinforced with synthetic fibers, such as nylon or fiberglass. A paper product may be or impregnated with nonfibrous materials, such as plastics, polymers, resins, or lotions. As used herein, the terms "paper web" and "web" are understood to include both forming and formed paper sheet materials, papers, and paper materials containing paper fibers. A paper product may be a coated, laminated, or composite paper material. A paper product can be bleached or unbleached.

Paper can include, but is not limited to, writing papers and printing papers (e.g., uncoated mechanical, coated free sheet, coated mechanical, uncoated free sheet, and the like), industrial papers, tissue papers of all varieties, paperboards, cardboards, packaging papers (e.g., unbleached Kraft paper, bleached Kraft paper), wrapping papers, paper adhesive tapes, paper bags, paper cloths, toweling, wallpapers, carpet backings, paper filters, paper mats, decorative papers, saturating and laminating papers, facing papers, disposable linens and garments, and the like.

Paper can include tissue paper products. Tissue paper products include sanitary tissues, household tissues, industrial tissues, facial tissues, cosmetic tissues, soft tissues, absorbent tissues, medicated tissues, toilet papers, paper towels, paper napkins, paper cloths, paper linens, and the like.

Common paper products include printing grades (e.g., newsprint, catalog, publication, banknote, document, bible, bond, ledger, stationery), industrial grades (e.g., bag, linerboard, corrugating medium, construction paper, greaseproof, glassine), and tissue grades (sanitary, toweling, condenser, wrapping).

A tissue paper may be a feltpressed tissue paper, a pattern densified tissue paper, or a high bulk, uncompacted tissue paper. A tissue paper may be characterized as: creped or uncreped; of a homogeneous or multilayered construction; layered or non-layered (blended); and/or one-ply, two-ply, or three or more plies. Tissue paper may include soft and absorbent paper tissue products such as consumer tissue products.

Paperboard is thicker, heavier, and less flexible than conventional paper. Many hardwood and softwood tree species are used to produce paper pulp by mechanical and chemical processes that separate the fibers from the wood matrix. Paperboard can include, but is not limited to, semi-chemical paperboard, linerboards, containerboards, corrugated medium, folding boxboard, and cartonboards.

Paper may refer to a paper product such as dry paper board, fine paper, towel, tissue, and newsprint products. Dry paper board applications include liner, corrugated medium, bleached, and unbleached dry paper board.

Paper can include carton board, container board, and special board/paper. Paper can include boxboard, folding boxboard, unbleached kraft board, recycled board, food packaging board, white lined chipboard, solid bleached board, solid unbleached board, liquid paper board, linerboard, corrugated board, core board, wallpaper base, plaster board, book bindery board, woodpulp board, sack board, coated board, and the like.

"Pulp" refers to a fibrous cellulosic material. Suitable fibers for the production of the pulps are all conventional grades, for example mechanical pulp, bleached and unbleached chemical pulp, recycled pulp, and paper stocks obtained from all annuals. Mechanical pulp includes, for example, groundwood, thermomechanical pulp (TMP), chemithermomechanical pulp (CTMP), bleached chemithermomechanical pulp (BCTMP), alkaline peroxide mechanical pulp (APMP), groundwood pulp produced by pressurized grinding, semi-chemical pulp, high-yield chemical pulp and refiner mechanical pulp (RMP). Examples of suitable chemical pulps are sulfate, sulfite, and soda pulps. The unbleached chemical pulps, which are also referred to as unbleached Kraft pulp, can particularly be used.

"Pulp slurry" refers to a mixture of pulp and water. The pulp slurry is prepared in practice using water, which can be partially or completely recycled from the paper machine. It can be either treated or untreated white water or a mixture of such water qualities. The pulp slurry may contain interfering substances (e.g., fillers). The filler content of paper may be up to about 40% by weight. Suitable fillers are, for example, clay, kaolin, natural and precipitated chalk, titanium dioxide, talc, calcium sulfate, barium sulfate, alumina, satin white or mixtures of the stated fillers.

"Papermaking process" is a method of making paper products from pulp comprising, inter alia, forming an aqueous pulp slurry that can include cellulosic fiber, draining the pulp slurry to form a sheet, and drying the sheet. The steps of forming from the papermaking furnish, draining, and drying may be carried out in any conventional manner generally known to those skilled in the art.

General Discussion

The various exemplary embodiments described herein include paper materials that may be formed by treating a cellulosic fiber or an aqueous pulp slurry with a treatment composition comprising an anionic polyacrylamide resin and an aldehyde-functionalized polymer resin and thereafter forming a paper web and drying the web to form paper. In an exemplary embodiment, the complex of the anionic polyacrylamide to the aldehyde-containing polymer has a net cationic charge. In exemplary treatment compositions, the aldehyde-containing polymer can be a glyoxalated polyacrylamide (GPAM) with more than 10 wt % cationic monomer in the base polymer.

An exemplary treatment composition can provide superior retention performance and strength characteristics. Although not intending to be bound by theory, the components of the anionic polyacrylamide resin and the aldehyde-functionalized polymer resin can form complexes through electrostatic interaction and covalent bonding. In contrast, conventional systems only interact through electrostatic interactions. The strong interaction among the components of the anionic polyacrylamide resin and the aldehyde-functionalized polymer resin provides unexpected and surprising retention and strength performance over other treatment compositions. In an exemplary embodiment, the treated cellulosic fiber or aqueous pulp slurry may show an improved fiber retention and/or particulate retention (e.g., fillers and the like) (also referred to herein as "fiber/particulate" retention) in the paper web, relative to cellulosic fiber or aqueous pulp slurry that is not treated. In an exemplary embodiment, the improved retention is about 1 to 90% relative to cellulosic fiber or aqueous pulp slurry that is not treated.

According to an exemplary embodiment, the treated cellulosic fiber or aqueous pulp slurry may show an improved fiber dewatering rate relative to cellulosic fiber or aqueous pulp slurry that is not treated. An exemplary treatment composition can be used to increase paper dry strength and increase fixation of fine and fillers.

In an exemplary embodiment, the anionic polyacrylamide resin can be a copolymer of anionic monomer and non-ionic monomers such as acrylamide or methacrylamide. Examples of suitable anionic monomers include acrylic acid, methacrylic acid, methacrylamide 2-acrylamido-2-methylpropane sulfonate (AMPS), styrene sulfonate, and mixture thereof as well as their corresponding water soluble or dispersible alkali metal and ammonium salts. The anionic high molecular weight polymers useful in embodiments of this disclosure may also be either hydrolyzed acrylamide polymers or copolymers of acrylamide or its homologues, such as methacrylamide, with acrylic acid or its homologues, such as methacrylic acid, or with polymers of such vinyl monomers as maleic acid, itaconic acid, vinyl sulfonic acid, or other sulfonate containing monomers. Anionic polymers may contain sulfonate or phosphonate functional groups or mixtures thereof, and may be prepared by derivatizing polyacrylamide or polymethacrylamide polymers or copolymers. The most preferred high molecular weight anionic flocculants are acrylic acid/acrylamide copolymers, and sulfonate containing polymers such as those prepared by the polymerization of such monomers as 2-acrylamide-2-methylpropane sulfonate, acrylamido methane sulfonate, acrylamido ethane sulfonate and 2-hydroxy-3-acrylamide propane sulfonate with acrylamide or other non-ionic vinyl monomer. When used herein the polymers and copolymers of the anionic vinyl monomer may contain as little as 1 mole percent of the anionically charged monomer, and preferably at least 10 mole percent of the anionic monomer. Again, the choice of the use of a particular anionic polymer may be dependent upon furnish, filler, water quality, paper grade, and the like.

An exemplary anionic polyacrylamide resin may further contain monomers other than the above described monomers, more specifically, nonionic monomers and cationic monomers, provided the net charge of the polymer is anionic. Examples of nonionic monomers include dialkylaminoalkyl(meth)acrylates such as dimethylaminoethyl (meth)acrylate; dialkylaminoalkyl(meth)acrylamides such as dialkylaminopropyl(meth)acrylamides; and N-vinylformamide, styrene, acrylonitrile, vinyl acetate, alkyl(meth) acrylates, alkoxyalkyl(meth)acrylates, and the like. Suitable cationic vinyl monomers useful may be well known to those skilled in the art. These materials include: dimethylaminoethyl methacrylate (DMAEM), dimethylaminoethyl acrylate (DMAEA), diethylaminoethyl acrylate (DEAEA), diethylaminoethyl methacrylate (DEAEM) or their quaternary ammonium forms made with dimethyl sulfate or methyl chloride, Mannich reaction modified polyacrylamides, diallylcyclohexylamine hydrochloride (DACHA HCl), dial lyldimethylammonium chloride (DADMAC), methacrylamidopropyltrimethylammonium chloride (MAPTAC), vinylpyridine, vinylimidazole, and allyl amine (ALA).

An exemplary anionic polyacrylamide resin can have a standard viscosity higher than 1 or higher than 1.5 or higher than 1.8. In an exemplary embodiment, the anionic polyacrylamide resin can have a charge density of about 1 to 100 wt % or about 5 to 70 wt % or about 10 to 50 wt %.

An exemplary aldehyde-functionalized polymer resin can be produced by reacting a polymer including one or more hydroxyl, amine, or amide groups with one or more aldehydes. An exemplary polymeric aldehyde-functionalized polymer resin can comprise gloxylated polyacrylamides, aldehyde-rich cellulose, aldehyde-functional polysaccharides, or aldehyde functional cationic, anionic or non-ionic starches. Exemplary materials include those disclosed in U.S. Pat. No. 4,129,722, which is incorporated herein by reference. An example of a commercially available soluble cationic aldehyde functional starch is Cobond® 1000 marketed by National Starch. Additional exemplary aldehyde-functionalized polymers may include aldehyde polymers such as those disclosed in U.S. Pat. No. 5,085,736; U.S. Pat. No. 6,274,667; and U.S. Pat. No. 6,224,714; all of which are incorporated herein by reference, as well as the those of WO 00/43428 and the aldehyde functional cellulose described in WO 00/50462 A1 and WO 01/34903 A1. In an exemplary embodiment, the polymeric aldehyde-functional resins can have a molecular weight of about 10,000 Da or greater, about 100,000 Da or greater, or about 500,000 Da or greater. Alternatively, the polymeric aldehyde-functionalized resins can have a molecular weight below about 200,000 Da, such as below about 60,000 Da.

Further examples of aldehyde-functionalized polymers can include dialdehyde guar, aldehyde-functional additives further comprising carboxylic groups as disclosed in WO 01/83887, dialdehyde inulin, and the dialdehyde-modified anionic and amphoteric polyacrylamides of WO 00/11046, each of which are incorporated herein by reference. Another exemplary aldehyde-functionalized polymer is an aldehyde-containing surfactant such as those disclosed in U.S. Pat. No. 6,306,249, which is incorporated herein by reference.

When used in an exemplary embodiment, the aldehyde-functionalized polymer can have at least about 5 milliequivalents (meq) of aldehyde per 100 grams of polymer, at least about 10 meq, about 20 meq or greater, or about 25 meq, per 100 grams of polymer or greater.

An exemplary polymeric aldehyde-functionalized polymer can be a glyoxylated polyacrylamide, such as a cationic glyoxylated polyacrylamide as described in U.S. Pat. No. 3,556,932, U.S. Pat. No. 3,556,933, U.S. Pat. No. 4,605,702, U.S. Pat. No. 7,828,934, and U.S. Patent Application 2008/0308242, each of which is incorporated herein by reference. Such compounds include FENNOBOND™ 3000 and PAREZ™ 745 from Kemira Chemicals of Helsinki, Finland, HERCOBOND™ 1366, manufactured by Hercules, Inc. of Wilmington, Del.

An exemplary aldehyde functionalized polymer is a glyoxalated polyacrylamide resin having the ratio of the number of substituted glyoxal groups to the number of glyoxal-reactive amide groups being in excess of about 0.03:1, being in excess of about 0.10:1, or being in excess of about 0.15:1.

An exemplary aldehyde functionalized polymer can be a glyoxalated polyacrylamide resin having a polyacrylamide backbone with a weight ratio of acrylamide to dimethyldiallylammonium chloride less than 90:10, or less than 85:15, or less than 80:20. In an exemplary embodiment, the weight average molecular weight of the polyacrylamide backbone can be about 250,000 Da or less, about 150,000 Da or less, or about 100,000 Da or less. The Brookfield viscosity of the polyacrylamide backbone can be about 10 to 10,000 cps, about 25 to 5000 cps, about 50 to 2000 cps, for a 40% by weight aqueous solution.

In an exemplary embodiment, the complex of the anionic polyacrylamide resin and the aldehyde-functionalized polymer resin possesses a net cationic charge. In an exemplary embodiment, the weight ratio of the anionic polyacrylamide resin and an aldehyde-functionalized polymer resin can be about 1:100 to 100:1, or about 1:50 to 50:1, or about 1:20 to 20:1. It should be noted in an exemplary embodiment the ratio can be modified to provide performance and/or cost characteristics, as necessary or desired.

An exemplary treatment composition may also include one or more of the following: a cationic coagulant or a starch. In an exemplary embodiment, the cationic coagulant can include an in-organic coagulant, an organic coagulant, or a combination thereof. Exemplary in-organic coagulants include alum, polyaluminum chloride (PAC), and silicate polyaluminum chloride. Exemplary organic coagulants include polyDADMAC, copolymers of DADMAC, cationic polyacrylamide, polyDIMAPA, condensation copolymers of dimethylamine and epichlorohydrin, condensation copolymers of dimethylamine, epichlorohydrin, and ethylene diamine, polyamidoamine epichlorohydrin, polyamine epichlorohydrin, polyamine polyamidoamine epichlorohydrin, vinylamine-containing polymers, polyethylenimine (PEI), PEI-containing polymers, chitosan, and cationic guar. Exemplary starches include cationic, anionic, and/or amphoteric starches, such as those that are readily available by derivatization of starch. Exemplary starches include, without limitation, corn, waxy maize, potato, wheat, tapioca, or rice starches, or the like. In some embodiments, the treatment composition includes a starch (cationic, anionic and/or amphoteric) having a degree of substitution (DS) of 0.001 to 0.5%. In other embodiments, the treatment composition may include a starch having a DS of 0.03 to 0.4%. In yet other embodiments, the treatment composition may include a starch having a DS of 0.04 to 0.3.

An exemplary treatment composition may also include one or more cationic polymer flocculants. Exemplary polymer flocculants include homopolymers of water soluble cationic vinyl monomers, and copolymers of a water soluble cationic vinyl monomer with a nonionic monomer such as acrylamide or methacrylamide. The polymers may contain only one cationic vinyl monomer, or may contain more than one cationic vinyl monomer. Alternatively, certain polymers may be modified or derivatized after polymerization such as polyacrylamide by the Mannich reaction to produce a cationic vinyl polymer useful in embodiments of the present disclosure. The polymers may have been prepared from as little as 1 mole percent cationic monomer to 100 mole percent cationic monomer, or from a cationically modified functional group on a post polymerization modified polymer. Exemplary cationic flocculants can have at least 5 mole percent of cationic vinyl monomer or functional group, or at least 10 weight percent of cationic vinyl monomer or functional group. Suitable cationic vinyl monomers useful in making the cationically charged vinyl addition copolymers and homopolymers of exemplary embodiments may be well known to those skilled in the art. Exemplary vinyl monomers include: dimethylaminoethyl methacrylate (DMAEM), dimethylaminoethyl acrylate (DMAEA), diethylaminoethyl acrylate (DEAEA), diethylaminoethyl methacrylate (DEAEM) or their quaternary ammonium forms made with dimethyl sulfate or methyl chloride, Mannich reaction modified polyacrylamides, diallylcyclohexylamine hydrochloride (DACHA HCl), diallyldimethylammonium chloride (DADMAC), methacrylamidopropyltrimethylammonium chloride (MAPTAC) and allyl amine (ALA). Those skilled in the art of cationic polymer based retention programs can readily appreciate that the selection of a particular polymer may depend on one or more properties of the paper system, including, for example, furnish, filler, grade, and water quality.

One or more of the exemplary treatment compositions may be provided to a pulp slurry, which may be used to produce a paper product. As a result, the treatment composition can be dispersed throughout the resultant paper product.

An exemplary treatment composition (or one or more components thereof) can be applied to the cellulosic fibers, fibrous slurry, or individual fibers. According to exemplary embodiments, the treatment composition (or one or more components thereof) can be applied in the form of an aqueous solution, a suspension, a slurry, or as a dry reagent, as necessary or desired, depending upon the particular application. In one exemplary embodiment, treatment composition may be provided as a dry reagent, with sufficient water to permit interaction of the components of the treatment composition.

In an exemplary embodiment, the individual components of the treatment composition may be combined first and then applied to the cellulosic fibers. In another exemplary embodiment, the individual components may be applied sequentially in any order. In another exemplary embodiment, the groups of individual components can be combined and then applied to the cellulosic fibers simultaneously or sequentially.

By way of example only, the treatment composition (or one or more components thereof) can be applied by any of the following methods or combinations thereof.

An exemplary method can include direct addition of the treatment composition (or one or more components thereof) to a fibrous slurry, such as by injection of the component into a slurry prior to entry in the headbox. In an exemplary embodiment, the slurry can be about 0.05% to about 50%, about 0.1% to 10%, about 0.15% to about 5%, or about 0.2% to about 4%, of the treatment composition.

An exemplary method can include spraying the treatment composition (or one or more components thereof) on to a fibrous web. For example, spray nozzles may be mounted over a moving paper web to apply a desired dose of a solution to a web that can be moist or substantially dry.

An exemplary method can include application of the treatment composition (or one or more components thereof) by spray or other means to a moving belt or fabric, which in turn contacts the tissue web to apply the chemical to the web, such as is disclosed in WO 01/49937.

An exemplary method can include printing the treatment composition (or one or more components thereof) onto a web, such as by offset printing, gravure printing, flexographic printing, ink jet printing, digital printing of any kind, and the like.

An exemplary method can include coating the treatment composition (or one or more components thereof) onto one or both surfaces of a web, such as blade coating, air knife coating, short dwell coating, cast coating, and the like.

An exemplary method can include extrusion from a die head of the treatment composition (or one or more components thereof) in the form of a solution, a dispersion or emulsion, or a viscous mixture.

An exemplary method can include application of treatment composition (or one or more components thereof) to individualized fibers. For example, comminuted or flash dried fibers may be entrained in an air stream combined with an aerosol or spray of the compound(s) to treat individual fibers prior to incorporation into a web or other fibrous product.

An exemplary method can include impregnation of a wet or dry web with a solution or slurry of treatment composition (or one or more components thereof), where the treatment composition (or one or more components thereof) penetrates a significant distance into the thickness of the web, such as about 20% or more of the thickness of the web, about 30% or more of the thickness of the web, and about 70% or more of the thickness of the web, including completely penetrating the web throughout the full extent of its thickness.

An exemplary method for impregnation of a moist web can include the use of the Hydra-Sizer® system, produced by Black Clawson Corp., Watertown, N.Y., as described in "New Technology to Apply Starch and Other Additives," Pulp and Paper Canada, 100(2): T42-T44 (February 1999). This system includes a die, an adjustable support structure, a catch pan, and an additive supply system. A thin curtain of descending liquid or slurry is created which contacts the moving web beneath it. Wide ranges of applied doses of the coating material are said to be achievable with good runnability. The system can also be applied to curtain coat a relatively dry web, such as a web just before or after creping.

An exemplary method can include a foam application of the treatment composition (or one or more components thereof) to a fibrous web (e.g., foam finishing), either for topical application or for impregnation of the additive into the web under the influence of a pressure differential (e.g., vacuum-assisted impregnation of the foam). Principles of foam application of additives such as binder agents are described in the following publications: F. Clifford, "Foam Finishing Technology: The Controlled Application of Chemicals to a Moving Substrate," Textile Chemist and Colorist, Vol. 10, No. 12, 1978, pages 37-40; C. W. Aurich, "Uniqueness in Foam Application," Proc. 1992 Tappi Nonwovens Conference, Tappi Press, Atlanta, Ga., 1992, pp. 15-19; W. Hartmann, "Application Techniques for Foam Dyeing & Finishing", Canadian Textile Journal, April 1980, p. 55; U.S. Pat. No. 4,297,860, and U.S. Pat. No. 4,773,110, each of which is incorporated herein by reference.

An exemplary method can include padding of a solution containing the treatment composition (or one or more components thereof) into an existing fibrous web.

An exemplary method can include roller fluid feeding of a solution of treatment composition (or one or more components thereof) for application to the web.

When applied to the surface of a paper web, an exemplary embodiment of the present disclosure may include the topical application of the treatment composition (or one or more components thereof) on an embryonic web prior to Yankee drying or through drying.

In an exemplary embodiment, the application level of the treatment composition can be about 0.05% to about 10% by weight relative to the dry mass of the web for any of the treatment compositions. In exemplary embodiment, the application level can be about 0.05% to about 4%, or about 0.1% to about 2%. Higher and lower application levels are also within the scope of the embodiments. In some embodiments, for example, application levels of from about 5% to about 50% or higher can be considered.

An exemplary treatment composition, when combined with the web or with cellulosic fibers, can have any pH, though in many embodiments it is desired that the dewatering/treatment composition is in solution in contact with the web or with fibers have a pH below about 10, about 9, about 8 or about 7, such as about 2 to about 8, about 2 to about 7, about 3 to about 6, and about 3 to about 5.5. Alternatively, the pH range may be about 5 to about 9, about 5.5 to about 8.5, or about 6 to about 8. These pH values can apply to one or more of the components of the treatment composition polymer prior to contacting the web or fibers, or to a mixture of the dewatering/treatment composition in contact with the web or the fibers prior to drying.

In an exemplary embodiment, before the treatment composition is applied to an existing web, such as a moist embryonic web, the solids level of the web may be about 10% or higher (i.e., the web comprises about 10 grams of dry solids and 90 grams of water, such as about any of the following solids levels or higher: about 12%, about 15%, about 18%, about 20%, about 25%, about 30%, about 35%, about 40%, about 45%, about 50%, about 60%, about 75%, about 80%, about 90%, about 95%, about 98%, and about 99%, with exemplary ranges of about 30% to about 100% or about 65% to about 90%).

Ignoring the presence of chemical compounds other than the treatment composition and focusing on the distribution of the treatment composition in the web, one skilled in the art can recognize that the treatment composition (including one or more components and/or derivatives thereof) can be distributed in a wide variety of ways. For example, the treatment composition may be uniformly distributed, or present in a pattern in the web, or selectively present on one surface or in one layer of a multilayered web. In multilayered webs, the entire thickness of the paper web may be subjected to application of the treatment composition and other chemical treatments described herein, or each individual layer may be independently treated or untreated with the treatment composition and other chemical treatments of the present disclosure. In an exemplary embodiment, the treatment composition is predominantly applied to one layer in a multilayer web. Alternatively, at least one layer is treated with significantly less treatment composition than other layers. For example, an inner layer can serve as a treated layer.

An exemplary treatment composition may also be selectively associated with one of a plurality of fiber types, and may be adsorbed or chemisorbed onto the surface of one or more fiber types. For example, bleached kraft fibers can have a higher affinity for the treatment composition than synthetic fibers that may be present.

In an exemplary embodiment, certain chemical distributions may occur in webs that are pattern densified, such as the webs disclosed in any of the following U.S. Pat. No. 4,514,345; U.S. Pat. No. 4,528,239; U.S. Pat. No. 5,098,522; U.S. Pat. No. 5,260,171; U.S. Pat. No. 5,275,700; U.S. Pat. No. 5,328,565; U.S. Pat. No. 5,334,289; U.S. Pat. No. 5,431,786; U.S. Pat. No. 5,496,624; U.S. Pat. No. 5,500,277; U.S. Pat. No. 5,514,523; U.S. Pat. No. 5,554,467; U.S. Pat. No. 5,566,724; U.S. Pat. No. 5,624,790; and U.S. Pat. No. 5,628,876, the disclosures of which are incorporated herein by reference to the extent that they are non-contradictory herewith.

An exemplary treatment composition or other chemicals can be selectively concentrated in the densified regions of the web (e.g., a densified network corresponding to regions of the web compressed by an imprinting fabric pressing the web against a Yankee dryer, where the densified network can provide good tensile strength to the three-dimensional web). This is particularly so when the densified regions have been imprinted against a hot dryer surface while the web is still wet enough to permit migration of liquid between the fibers to occur by means of capillary forces when a portion of the web is dried. In this case, migration of the aqueous solution of treatment composition can move the treatment composition toward the densified regions experiencing the most rapid drying or highest levels of heat transfer.

The principle of chemical migration at a microscopic level during drying is well attested in the literature. See, for example, A. C. Dreshfield, "The Drying of Paper," Tappi Journal, Vol. 39, No. 7, 1956, pages 449-455; A. A. Robertson, "The Physical Properties of Wet Webs. Part I," Tappi Journal, Vol. 42, No. 12, 1959, pages 969-978; U.S. Pat. No. 5,336,373, and U.S. Pat. No. 6,210,528, each of which is herein incorporated by reference.

Without wishing to be bound by theory, it is believed that chemical migration may occur during drying when the initial solids content (dryness level) of the web is below about 60% (e.g., less than any of about 65%, about 63%, about 60%, about 55%, about 50%, about 45%, about 40%, about 35%, about 30%, and about 27%, such as about 30% to 60%, or about 40% to about 60%). The degree of chemical migration can depend, for example, on the surface chemistry of the fibers, the chemicals involved, the details of drying, the structure of the web, and so forth. On the other hand, if the web with a solid contents below about 60% is through-dried to a high dryness level, such as at least any of about 60% solids, about 70% solids, and about 80% solids (e.g., from 65% solids to 99% solids, or from 70% solids to 87% solids), then regions of the web disposed above the deflection conduits (i.e., the bulky "domes" of the pattern-densified web) may have a higher concentration of treatment composition or other water-soluble chemicals than the densified regions, for drying tend to occur first in the regions of the web through which air can readily pass, and capillary wicking can bring fluid from adjacent portions of the web to the regions where drying is occurring most rapidly. In short, depending on how drying is carried out, water-soluble reagents may be present at a relatively higher concentration (compared to other portions of the web) in the densified regions or the less densified regions ("domes").

An exemplary treatment composition (or one or more components or derivatives thereof) may also be present substantially uniformly in the web, or at least without a selective concentration in either the densified or undensified regions.

According to an exemplary method, the conditions (e.g., temperature of the pulp slurry, temperature of pre-mixing the components, time of pre-mixing the components, concentration of the paper solution, co-mixing of solids, and the like) of the pulp slurry and process can vary, as necessary or desired, depending on the particular paper product to be formed, characteristics of the paper product formed, and the like. In an embodiment, the temperature of the pulp slurry can be about 10 to 80° C. when the treatment composition is added to the pulp slurry. In an embodiment, the process variables may be modified as necessary or desired, including, for example, the temperature of pre-mixing the components, the time of pre-mixing the components, and the concentration of the pulp slurry.

In various exemplary embodiments a paper may be formed by the treatment of a cellulosic fiber or an aqueous pulp slurry with a treatment composition as described herein. The paper can be formed using one or more methods, including those described herein.

EXAMPLES

Now having described the embodiments, in general, the examples describe some additional embodiments. While embodiments are described in connection with the examples and the corresponding text and figures, there is no intent to limit embodiments of the disclosure to these descriptions. On the contrary, the intent is to cover all alternatives, modifications, and equivalents included within the spirit and scope of exemplary embodiments.

Charge Titration

Polymer charge density was determined using a Mutek PCD-03 titrator. The cationic titrant was 0.001 N poly (dimethyldiallyammonium chloride) and the anionic titrant was 0.001 N poly(vinylsulfate). In a typical experiment, 0.2 to 0.5 mL of polymer solution (1 wt %) was added the burette and diluted with 10 mL de-ionized water. The pH was then adjusted to 7.5 for the anionic polymer and 4.0 for the cationic polymer. Afterwards, the oppositely charged titrant was added slowly until the charge indicator reached the end point (neutral charge), where the amount of the titrant consumed was used to calculate polymer charge density (mEq/g).

Standard Viscosity (SV)

The standard viscosity method was applied in this study to characterize linear polymer molecular weight. The standard viscosity refers to the viscosity (in cps) of 0.100 wt % active polymer in 1 M NaCl. A higher standard indicates a higher molecular weight. For a typical standard viscosity measurement, the neat product (emulsion, dry, or solution) was first diluted in de-ionized water to a concentration of 0.2 wt % and stirred for 45 minutes using a Lightning mixer under ambient temperature. Afterwards, the product is further diluted to 0.1% in 1 M NaCl solution and stirred for additional 5 minutes. The pH of the solution was adjusted to 8.0-8.5 for anionic flocculants and <7.0 for cationic flocculants. The final solution was filtered through a nylon filter and its viscosity was measured using a Brookfiled DV-II Viscometer with a ULA adapter and spindle set.

Glyoxalated Polyacrylamide Samples

Three glyoxalated polyacrylamide (GPAM) samples were prepared by the crosslinking reaction between a poly(acrylamide-co-dimethyldiallylammonium chloride) base polymer and glyoxal as discussed in U.S. Pat. Nos. 3,556,932 and 4,605,702 and U.S. Patent Application Publications 2008/0308242 and 2009/0071618 (each of which is incorporated herein by reference). Table 1 shows the properties of three GPAM samples.

TABLE 1

GPAM properties

| Samples | Base polymer Mw (Da) | Base polymer DADMAC content (wt %) | Glyoxal/base polymer weight ratio | GPAM active contents (wt %) | GPAM viscosity (cps) | GPAM charge density (meq/g) |
|---|---|---|---|---|---|---|
| GPAM A | 12000 | 10 | 3:10 | 7 | 20 | +0.3 |
| GPAM B | 10000 | 30 | 3:10 | 12 | 28 | +1.2 |
| GPAM C | 10000 | 58 | 3:10 | 14 | 22 | +2.3 |

High Molecular Weight Flocculants

Various commercial flocculants from Kemira Chemicals were evaluated in combination with GPAM samples and their properties are summarized in Table 2. Molecular weight is commonly considered an important property of flocculants and a higher molecular weight typically produces superior retention/drainage performance. A wide range of commercial APAM samples were chosen in this study to study the impact of APAM molecular weight on retention/drainage. APAM 1 has the highest molecular weight, which corresponds to a SV of 8.2. In comparison, commercial CPAM flocculants are produced at significantly lower molecular weights. The highest molecular weight CPAM used in this study has a SV of 4.3.

TABLE 2

| Flocculant properties | | | | |
|---|---|---|---|---|
| Flocculant | Description | Charge content | Charge density (mEq/g) | Standard viscosity (cps) |
| APAM 1 (1883) | copolymer of acrylic acid and acrylamide emulsion | 30 mol. % | −3.6 | 8.2 |
| APAM 2 (85) | copolymer of acrylic acid and acrylamide solution | 10 mol. % | −1.2 | 1.2 |
| APAM 3 (130 V) | Dry copolymer of acrylic acid and acrylamide | 30 mol. % | −3.6 | 7.3 |
| APAM 4 (130) | Dry copolymer of acrylic acid and acrylamide | 30 mol. % | −3.6 | 5.5 |
| APAM 5 (786) | copolymer of acrylic acid and acrylamide solution | 30 mol. % | −3.6 | 1.3 |
| CPAM 1 | Dry copolymer of dimethylaminoethyl acrylate methyl chloride quaternary salt and acrylamide | 8 mol. % | NA | 3.5 |
| CPAM 2 | Dry copolymer of dimethylaminoethyl acrylate methyl chloride quaternary salt and acrylamide | 8 mol. % | NA | 4.3 |

Comparison Cationic Coagulants

In this study, two common commercial cationic coagulants were tested in comparison to GPAM samples. Table 3 summarizes the properties of these two coagulants.

TABLE 3

| Cationic coagulant properties | | |
|---|---|---|
| Chemistry | Charge Density (mEq/g) | Description |
| Polyamine | 6.5 | Copolymer of dimethylamine, epichlorohydrin, and ethylene diamine, 50%, viscosity = 300 cps. |
| PolyDADMAC | 6.0 | Polydiallydimethammonium chloride 20%, viscosity = 850 cps |

Pulp furnishes containing about 2 to 5% dry mass were obtained from various paper machines and diluted with white water from the same machine to a final 0.8-0.9% dry mass. The pH was adjusted to 7.0 to 8.0 using 0.5 N of sodium hydroxide or hydrochloric acid. The additional dosages of glyoxalated polyacrylamide and anionic polyacrylamide were based on dry chemical mass and dry fiber mass. A DFR 05 (BTG Americas) was used for the evaluation. About 1000 mL of diluted pulp furnish is placed into DFRO5 for the chemical treatment. The stirrer is set at 800 RPM for 25 seconds of total mixing time. Detailed contact time and chemical addition sequence are shown as follow:

@ 0 seconds start the stirrer
@ 5 seconds GPAM/coagulants
@ 15 seconds flocculants
@ 25 seconds stop stirrer and drain the pulp After the stirrer stops, the treated pulp is filtered through a 40-mesh or 50-mesh screen. The amount of the filtrate collected after 80 seconds or the time to collect 700 g of filtrate was recorded as an indication of drainage rate. The turbidity of the filtrate was measured by HACH 2100P and used as an indication for retention.

Handsheet Preparation

Handsheets were prepared using a pulp mixture of bleached hardwood and bleached softwood. Deionized water was used for furnish preparation, an additional 150 ppm of sodium sulfate and 35 ppm of calcium chloride were added. While mixing with an overhead agitator, a batch of 0.6% solids containing 8.7 g of cellulose fibers was treated with various strength agent samples (described below) that were diluted to 1% weight % with deionized water. After the addition of the strength agent, the pulp slurry was mixed for 30 seconds. Then, four 3-g sheets of paper were formed using a standard (8"×8") Nobel & Woods handsheet mold, to target a basis weight of 52 lbs/3470 $ft^2$. The handsheets were pressed between felts in the nip of a pneumatic roll press at about 15 psig and dried on a rotary dryer at 110° C. The paper samples were oven cured for 10 minutes at the temperature of 110° C., then conditioned in the standard TAPPI control room for overnight.

Dry Tensile Strength Test

Tensile strength is measured by applying a constant-rate-of-elongation to a sample and recording the force per unit width required to break a specimen. This procedure references TAPPI Test Method T494 (2001), which is incorporated herein by reference, and modified as described.

Initial Wet Tensile Strength Test

This test method is used to determine the initial wet tensile strength of paper or paperboard that has been in contact with water for 2 seconds. A 1-inch wide paper strip sample is placed in the tensile testing machine and wetted on both strip sides with distilled water by a paint brush. After the contact time of 2 seconds, the strip is elongated as set forth in 6.8-6.10 of TAPPI Test Method 494(2001). The initial wet tensile is useful in the evaluation of the performance characteristics of tissue products, paper towels and other papers subjected to stress during processing or use while instantly wet. This method references U.S. Pat. No. 4,233,411, which is incorporated herein by reference, and is modified as described herein.

Permanent Wet Tensile Strength Test

This test method is used to determine the wet tensile strength of paper or paperboard that has been in contact with water for an extended period of 30 minutes. A 1-inch wide paper strip sample is soaked in water for 30 minutes and is placed in the tensile testing machine. The strip is elongated as set forth in 6.8-6.10 of TAPPI Test Method 494 (2001). A low permanent wet tensile strength indicates that the paper product can be repulped in water without significant mechanical energy or dispersed in water easily without clogging sewage systems.

Example 1

GPAM and APAM Used on 100% Recycled Mixed Office Paper

The furnish used in this example was a 100% mix of office paper. The pH of this furnish was about 7.0, and the conductivity was about 1300 μS/cm. The zeta potential of the fiber as measured with a Mutek ZDT06 and was measured to be −10.9 mV. The cationic demand as measured with a Mutek PCD03 and was measured to be 183 μEq./L. APAM 1 was selected to use with GPAM, and the results are shown in Table 4. APAM 1 used alone did not show a good retention and drainage benefit. However, there is a very strong synergy when used with GPAMs, especially with higher charged GPAM C. Both retention and drainage of dual-component programs were significantly better than either GPAM or APAM 1 alone. The drainage of the combination of GPAM C and APAM 1 was increased up to about 42%, and turbidity was reduced up to 66.5% compared to GPAM C used alone, as calculated from Table 4.

TABLE 4

Retention/drainage study of 100% recycled mixed office paper furnish

| GPAM | APAM | Charge of GPAM/APAM Complex (Eq/ton fiber) | Drainage (g) | Turbidity (NTU) |
|---|---|---|---|---|
| 4 lb/ton GPAM C | / | / | 413 | 221 |
| 4 lb/ton GPAM C | 0.67 lb/ton APAM 1 | +1.5 | 586 | 74.2 |
| 4 lb/ton GPAM B | / | / | 424 | 235 |
| 4 lb/ton GPAM B/ | 0.67 lb/ton APAM 1 | +0.5 | 489 | 143 |
| / | 0.67 lb/ton APAM 1 | / | 312 | 836 |
| / | / | / | 379 | 955 |

Example 2

GPAM and APAM Used on OCC Fiber

The furnish used in this example was 100% recycled fibers from old corrugated containers (OCC) for a packaging grade, mid ply (filler grade). The pH of the furnish was about 7.8, and the conductivity was 1350 μS/cm. The zeta potential of the fiber was −9.1 mV and cationic demand was 446 μEq./L. In this example, the drainage was recorded as the amount of the filtrate collected after 80 seconds. As shown in Table 5, 4 lb/ton of GPAM alone did not show a significant drainage benefit. However, there is a significant improvement for both retention (54% improvement) and drainage (11.3% of improvement) when 4 lb/ton GPAM B and C were used together with 0.67 lb/ton of APAM 1. In addition, GPAM C showed better results than GPAM B per dry solid basis.

Table 5 also shows a very strong correlation between retention/drainage performance and the net charge of the added GPAM/APAM complex. At 0.67 lb/ton of APAM 1, a net negative charge of the complex decreased the drainage rate in comparison with the blank experiment. Increasing the cationic charge content of the complex resulted in a significant drainage rate increase. At +3.1 Eq/ton, the GPAM C+APAM 1 complex increased the drainage rate by 12%.

TABLE 5

Retention/drainage study of 100% OCC furnish

| GPAM | APAM | Charge of GPAM/APAM complex (Eq/ton fiber) | Drainage (g) | Drainage increase over blank (%) | Turbidity (NTU) |
|---|---|---|---|---|---|
| / | / | / | 679 | / | 545 |
| 4 lb/ton GPAM C | / | / | 683 | 1% | 303 |
| 1.1 lb/ton GPAM C | 0.67 lb/ton APAM 1 | +0.1 | 684 | 1% | 347 |
| 2 lb/ton GPAM C | 0.67 lb/ton APAM 1 | +1.0 | 741 | 9% | 225 |
| 4 lb/ton GPAM C | 0.33 lb/ton APAM 1 | +3.6 | 731 | 8% | 193 |
| 4 lb/ton GPAM C | 0.67 lb/ton APAM 1 | +3.1 | 760 | 12% | 139 |
| 4 lb/ton GPAM A | / | / | 684 | 1% | 381 |
| 4 lb/ton GPAM A | 0.67 lb/ton APAM 1 | −0.5 | 602 | −11% | 353 |
| 4 lb/ton GPAM B | / | / | 686 | 1% | 311 |
| 2 lb/ton GPAM B | 0.67 lb/ton APAM 1 | 0 | 656 | −3% | 294 |
| 4 lb/ton GPAM B | 0.67 lb/ton APAM 1 | +1.1 | 738 | 9% | 193 |

Example 3

GPAM Compared with Commercial Cationic Coagulants

This example compared the GPAM products with two common commercial cationic coagulants. The furnish used in this example was 100% OCC fibers from a packaging board mill, mid ply (filler grade). The pH of the Furnish was about 7.5. The zeta potential of the fiber was −11.3 mV and cationic demand was 314 μEq./L. The drainage results were reported as the time needed to collect 700 grams of filtrate. As shown in Table 6, GPAM C still showed the best overall retention and drainage performance on a dry solid basis when the net charge of GPAM and APAM added was cationic. Even through polyamine and polyDADMAC have significantly higher charge densities and the net charge of chemical additives is more cationic, the retention and drainage performance are inferior to GPAM C. In this case, the synergistic effect of the high charge density of the cationic component in this complex is unique for GPAM. Similar retention and drainage performance are found from the program containing GPAM B.

TABLE 6

Comparison of GPAM sample with commercial coagulants

| Additive | APAM | Charge of GPAM/APAM complex (Eq/ton fiber) | Drainage (sec) | Turbidity (NTU) |
|---|---|---|---|---|
| / | / | / | 68 | 511 |
| 1 lb/ton Polyamine | 0.67 lb/ton APAM 1 | +1.9 | 46 | 307 |
| 2 lb/ton Polyamine | 0.67 lb/ton APAM 1 | +4.8 | 42 | 236 |
| 1 lb/ton PolyDADMAC | 0.67 lb/ton APAM 1 | +1.6 | 42 | 273 |
| 2 lb/ton PolyDADMAC | 0.67 lb/ton APAM 1 | +4.3 | 47 | 195 |
| 4 lb/ton GPAM A | 0.67 lb/ton APAM 1 | −0.5 | 79 | 340 |
| 8 lb/ton GPAM A | 0.67 lb/ton APAM 1 | 0 | 59 | 279 |
| 2 lb/ton GPAM B | 0.67 lb/ton APAM 1 | 0 | 60 | 279 |
| 4 lb/ton GPAM B | 0.67 lb/ton APAM 1 | +1.1 | 40 | 172 |
| 2 lb/ton GPAM C | 0.67 lb/ton APAM 1 | +1.0 | 37 | 174 |
| 4 lb/ton GPAM C | 0.67 lb/ton APAM 1 | +3.1 | 39 | 108 |

Example 4

The Effect of Flocculent

The effect of flocculant properties on retention/drainage was evaluated in this Example and the result is shown in Table 7. The furnish used in this example was same as in Example 3. The drainage results were reported as the time needed to collect 700 grams of filtrate. Commercial APAM products can be produced at significantly higher molecular weights than commercial CPAM products. Consequently, the highest molecular weight APAM sample in this study has a SV of 8.2 and the highest molecular weight CPAM sample in this study has a SV of 4.3. First, the retention/drainage performance of GPAM/APAM combination depends strongly on APAM molecular weight. Among four tested APAM samples, the highest molecular weight APAM 1 (SV=8.2) led to the highest drainage rate and the highest retention percentage at 0.33 lb/ton APAM. The $2^{nd}$ highest molecular weight APAM 3 (SV=7.3) led to the highest drainage rate and the highest retention percentage at 0.67 lb/ton APAM. In comparison, APAM 6 (SV=1.3) provided only a positive retention benefit but a negative drainage impact. Additionally, the GPAM/APAM combination showed superior retention/drainage performance to GPAM/CPAM combination. When used with 4 lb/ton GPAM C, 0.67 lb/ton of CPAM 2 showed almost no difference on drainage performance compared to used alone, and only slight retention benefit. The synergistic effect with GPAM is only valid for anionic PAM.

TABLE 7

Effect of flocculants on retention/drainage

| GPAM | Flocculant | Flocculant SV (cps) | Drainage (sec) | Turbidity (NTU) |
|---|---|---|---|---|
| / | / | / | 68 | 511 |
| 4 lb/ton GPAM C | 0.33 lb/ton APAM 1 | 8.2 | 48 | 169 |
| 4 lb/ton GPAM C | 0.67 lb/ton APAM 1 | 8.2 | 39 | 108 |
| 4 lb/ton GPAM C | 0.33 lb/ton APAM 3 | 7.3 | 60 | 207 |
| 4 lb/ton GPAM C | 0.67 lb/ton APAM 3 | 7.3 | 28 | 83 |
| 4 lb/ton GPAM C | 0.33 lb/ton APAM 4 | 5.5 | 71 | 227 |
| 4 lb/ton GPAM C | 0.67 lb/ton APAM 4 | 5.5 | 48 | 148 |
| 4 lb/ton GPAM C | 0.33 lb/ton APAM 5 | 1.3 | 80 | 247 |
| 4 lb/ton GPAM C | 0.67 lb/ton APAM 5 | 1.3 | 90 | 261 |
| 4 lb/ton GPAM C | 0.33 lb/ton CPAM 1 | 3.5 | 65 | 209 |
| 4 lb/ton GPAM C | 0.67 lb/ton CPAM 1 | 3.5 | 44 | 173 |
| 4 lb/ton GPAM C | 0.33 lb/ton CPAM 2 | 4.3 | 67 | 248 |

TABLE 7-continued

Effect of flocculants on retention/drainage

| GPAM | Flocculant | Flocculant SV (cps) | Drainage (sec) | Turbidity (NTU) |
|---|---|---|---|---|
| 4 lb/ton GPAM C | 0.67 lb/ton CPAM 2 | 4.3 | 47 | 180 |
| / | 0.67 lb/ton CPAM 2 | 4.3 | 47 | 382 |

Example 5

GPAM/APAM Impact on Paper Strength

It has been widely accepted that GPAM performance depends on the alkalinity level in the pulp suspension. Increasing the alkalinity level typically lowers the paper strength increase from GPAM products. As shown in Table 8, with 100 ppm alkalinity at pH 7.5, 9 lb/ton GPAM A did not provide any strength increase. In comparison, the combination of GPAM C and APAM 2 led to both high dry tensile strength increase and high wet tensile increase. Furthermore, the strength increase depends on the weight ratio of GPAM to APAM. At the ratio of 1:1, the paper products showed the highest dry tensile strength and also the highest wet tensile strength.

GPAM products contain aldehyde functional groups that can react covalently with APAM acrylamide functional groups. Upon mixing, cationic GPAM and APAM form strong complexes via both electrostatic interactions and also covalent interactions. As demonstrated in Table 8, this strong complex formation provided the highest strength increase at an optimal GPAM/APAM ratio. At lower ratios, there were not enough aldehyde groups to increase paper strength. At higher ratios, there were not enough APAM to form complexes with GPAM.

For industrial applications, the conventional GPAM products were commonly applied to produce packaging and board (P&B) paper grades. The fiber resources of those grades are often recycled old corrugated container boards (OCC) that often contain high filler contents and high alkalinity levels. The combination of high charge GPAM and APAM can be applied in this application to further enhance paper strength. In addition, this new program can also be applied to increase the production rate, saving the cost of a separate retention/drainage program and the associated pumping equipment.

TABLE 8

GPAM/APAM Impact on Paper Strength

| Samples | Charge of GPAM/APAM Complex (Eq/ton fiber) | Dry tensile (lb/in) | Dry tensile increase (%) | Initial wet tensile (lb/in) | Permanent wet tensile (lb/in) |
|---|---|---|---|---|---|
| Blank | | 20.1 ± 0.8 | NA | 0.9 ± 0.1 | 0.3 ± 0.1 |
| 9 lb/ton GPAM A | / | 19.3 ± 0.5 | 0 | 0.8 ± 0.1 | 0.5 ± 0.1 |
| 6.8 lb/ton GPAM C - 2.2 lb/ton APAM 2 | +5.9 | 24.1 ± 0.9 | 19.9 | 1.5 ± 0.6 | 1.4 ± 0.1 |
| 4.5 lb/ton GPAM C - 4.5 lb/ton APAM 2 | +2.2 | 24.5 ± 0.5 | 21.9 | 1.9 ± 0.1 | 1.7 ± 0.1 |
| 3.2 lb/ton GPAM C - 5.8 lb/ton APAM 2 | 0 | 23.4 ± 0.5 | 16.4% | 1.0 ± 0.1 | 0.5 ± 0.1 |

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. In an embodiment, the term "about" can include traditional rounding according to the numerical value provided and the technique/system/apparatus used. In addition, the phrase "about 'x' to 'y'" includes "about 'x' to about 'y'".

It should be emphasized that the above-described embodiments of the present disclosure are merely possible examples of implementations, and are merely set forth for a clear understanding of the principles of this disclosure. Many variations and modifications may be made to the above-described embodiment(s) of the disclosure without departing substantially from the spirit and principles of the disclosure. All such modifications and variations are intended to be included herein within the scope of this disclosure and protected by the following claims.

The invention claimed is:

1. A paper formed by a method comprising treating a cellulosic fiber or an aqueous pulp slurry with a treatment composition comprising: an anionic polyacrylamide resin and an aldehyde functionalized polymer resin, wherein the complex of the anionic polyacrylamide resin and the aldehyde-functionalized polymer resin possesses a net cationic charge.

2. The paper of claim 1, wherein the paper has a higher retention of fiber/particulate as compared to a paper that has not been treated with the treatment composition.

3. The paper of claim 1, wherein the treatment composition is about 0.01 to 2 wt % of the aqueous pulp slurry that includes the cellulosic fiber.

4. The paper of claim 1, wherein the weight ratio of aldehyde-functionalized polymer resin to anionic polyacrylamide resin is about 100:1 to about 1:100.

5. The paper of claim 1, wherein the anionic polyacrylamide resin is a copolymer with an overall anionic charge of about 5 to 70 mol %.

6. The paper of claim 1, wherein the anionic polyacrylamide resin has a standard viscosity higher than 1.5 cps.

7. The paper of claim 1, wherein the aldehyde-functionalized polymer has a charge density greater than 20%.

8. The paper of claim 1, wherein the paper is a paper product that is selected from the group consisting of a dry paper board, a fine paper, a towel, a tissue, and a newsprint product.

9. A cellulosic fiber treatment system comprising an anionic polyacrylamide resin and an aldehyde-functionalized polymer resin, wherein a complex of the anionic polyacrylamide resin and the aldehyde-functionalized polymer resin possesses a net cationic charge.

10. The treatment system of claim 9, wherein the weight ratio of the aldehyde-functionalized polymer resin to anionic polyacrylamide resin is about 100:1 to about 1:100.

11. The treatment system of claim 9 wherein the anionic polyacrylamide resin is a copolymer with an overall anionic charge of about 5 to 70 mol %, and a standard viscosity higher than 1.5 cps.

12. The treatment system of claim 9, wherein the anionic polyacrylamide resin and an aldehyde-functionalized polymer resin are added separately to the cellulosic fiber.

13. The treatment system of claim 9, wherein the anionic polyacrylamide resin and the aldehyde-functionalized polymer resin are applied to the cellulosic fiber simultaneously.

14. The treatment system of claim 9, wherein the anionic polyacrylamide resin and the aldehyde-functionalized polymer resin are applied to the cellulosic fiber sequentially.

* * * * *